US005927051A

United States Patent [19]

O'Connor et al.

[11] Patent Number: 5,927,051

[45] Date of Patent: Jul. 27, 1999

[54] PACKAGING A CONTINUOUS STRIP OF MATERIAL

[75] Inventors: Lawrence J. O'Connor; Mark B. Davidson; Darrell Van Mol, all of Winnipeg, Canada

[73] Assignees: KT Holdings Inc., Winnipeg, Canada; Stac-Pac Technologies Inc., Christchurch, Barbados

[21] Appl. No.: 08/889,737

[22] Filed: Jul. 8, 1997

Related U.S. Application Data

[63] Continuation-in-part of application No. 08/878,826, Jun. 19, 1997.

[51] Int. Cl.[6] ..... B65B 63/04; B65B 31/00; B65B 61/06

[52] U.S. Cl. ..... 53/429; 53/434; 53/435; 493/415; 493/357; 493/363; 206/494; 206/524.8

[58] Field of Search ..... 53/429, 116, 117, 53/434, 435, 513, 520, 157; 206/494, 524.8; 493/413, 414, 415, 410, 411, 437, 448, 439, 440, 357, 356, 363

[56] References Cited

U.S. PATENT DOCUMENTS

| | | | |
|---|---|---|---|
| 32,761 | 7/1861 | Elliot . | |
| 1,463,918 | 8/1923 | Borroughs . | |
| 1,985,676 | 12/1934 | Hand . | |
| 3,245,680 | 4/1966 | Harrison et al. | 493/413 |
| 3,351,992 | 11/1967 | Carter | 53/429 |
| 3,673,757 | 7/1972 | Willis | 53/429 |
| 3,684,275 | 8/1972 | Schweitzer et al. | 493/413 X |
| 3,729,367 | 4/1973 | Shore et al. | 53/429 |
| 3,739,544 | 6/1973 | Hanemann . | |
| 4,097,039 | 6/1978 | Fischer | 493/413 |
| 4,201,029 | 5/1980 | Lerner et al. | 53/429 |
| 4,240,854 | 12/1980 | Massey et al. | 53/429 X |
| 4,418,514 | 12/1983 | Spann | 53/434 X |
| 4,427,404 | 1/1984 | Yamada . | |
| 4,499,707 | 2/1985 | Desjobert et al. . | |
| 4,547,184 | 10/1985 | Bunch, Jr. . | |
| 4,597,748 | 7/1986 | Wolf . | |
| 4,603,817 | 8/1986 | O'Connor . | |
| 4,716,706 | 1/1988 | Boeckmann . | |
| 4,896,475 | 1/1990 | McAvinew | 53/117 |
| 4,941,374 | 7/1990 | Focke | 53/157 X |
| 5,036,977 | 8/1991 | Schofield et al. . | |
| 5,064,179 | 11/1991 | Martin . | |
| 5,087,140 | 2/1992 | Keeton et al. . | |
| 5,104,366 | 4/1992 | Bunch | 493/414 X |
| 5,177,934 | 1/1993 | Yamamoto | 53/434 X |
| 5,290,226 | 3/1994 | Green, Jr. . | |
| 5,529,564 | 6/1996 | Hediger . | |

FOREIGN PATENT DOCUMENTS

| | | | |
|---|---|---|---|
| B-22983/83 | 3/1986 | Australia . | |
| 0 383 501 | 8/1990 | European Pat. Off. . | |
| 47638 | 3/1982 | Japan | 53/116 |
| 2-182666 | 7/1990 | Japan . | |
| 1555205 | 4/1990 | U.S.S.R. | 53/429 |

*Primary Examiner*—Linda Johnson

*Attorney, Agent, or Firm*—Oliff, Berridge, PLC; Adrian D. Battison

[57] ABSTRACT

A package of a continuous strip of material includes a plurality of parallel side by side stacks each containing a length of the strip which is folded back and forth such that each folded portion of the stack is folded relative to the next portion about a line transverse to the strip and such that the side edges of the strip portions are aligned. The strip is continuous through each stack and is connected by a splice from the end of one stack to beginning of the next stack. The package can be compressed to reduce the height of the stacks and maintained in the compressed condition by an evacuated sealed bag. The package can have the stacks vertical or horizontal. The stacks are connected by a spliced portion so that the strip is continuous through the package. When the stacks are horizontal, the spliced portions are vertical and coplanar with the strips and at alternate ends. When the stacks are vertical, the spliced portions extend from the bottom to the top at one end of the stack.

40 Claims, 8 Drawing Sheets

PACKAGING A CONTINUOUS STRIP OF MATERIAL

This application is a continuation in part application of application Ser. No. 08/878,826 filed June 19th, 1997. This application is also related to co-pending application Ser. Nos. 08/906,291 filed Aug. 5th, 1997 and 08/939,815, 08/939,44 and 08/939,881 all filed Sep. 29th, 1997.

This invention relates to a package of a continuous strip of material and to a method for forming a package of a continuous strip of material.

BACKGROUND OF THE INVENTION

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

The purpose of the festooning method is for packaging the strip for supply to a machine using the strip. Some users prefer the festooned package relative to a wound package of this type of material. The festooned package contains a much greater length of material than a spirally wound pad. The festooned package can simply be located adjacent the machine without the necessity for any unwinding or support stand. In addition, both the leading end and the tail end of the package are available at the top of the package so that a series of the packages can be connected lead to tail to act as an extended supply. Yet further, since the material is simply laid into the package, there is less problem with tension control in the material as it is withdrawn from the package, in comparison with larger transverse wound packages where tension control of large packages can be a problem due to the inertia of the package thus requiring a driven unwind stand as well as material handling equipment for moving the large rolls. There is therefore no need when festooned packages are used for a complex unwind stand which takes up more space than may be available and involves significant cost.

Festooned packages are formed in a stuff container or box to properly enclose and contain the material and within which the material is stored during transportation for maintaining the material against compression and distortion due to the transfer of loads from surrounding packages. The cardboard container thus provides support for other similar stacked containers and prevents the transfer of loads from the stacked packages from causing excessive compression of packages at the bottom of a layer. The cardboard containers and the package structures used in the conventional arrangement however have a number of problems.

Firstly the container must be either recycled with the necessity of shipping the cardboard containers in the return direction to the supplier from the end user or they must be discarded, both at considerable expense.

Secondly the cardboard containers simply receive the material without significant compression so that there is wastage of space within the container due to the packaging of air with the material. In addition the conventional package structure does not minimize the amount of air spaces formed in the structure. The transportation costs of the material therefore are significantly increased by the large volume of the material which provides a density which is significantly below the optimum for most efficient transport.

Thirdly the presence of the essential box during formation of the structure provides a restriction to the proper control of the strip as it is laid down since the sides of the box provide limitations to the position and movement of the guide member controlling the strip.

Fourthly it has been noted that the sides of the box which are parallel to the strips as they are laid down do not closely confine the sides of the package structure with the significant danger that the strips can fall down between the edge of the package and the box side.

In addition, the conventional technique for forming the package in which each of the strips slit from a web of supply material is individually packaged at a separate festooning station is slow and requires a large amount of floor space for the large number of stations. Also the large area covered by the stations causes a significant distance to be travelled by the strip from the slitting station to the festooning station with the potential for strip tension problems and damage to the strip.

There remains therefore a significant requirement for a package of this type but the techniques presently available are unsatisfactory for the above reasons leaving opportunity for an improved package structure.

SUMMARY OF THE INVENTION

It is one object of the present invention, therefore, to provide an improved package structure and a method of packaging a strip of material in which the stability of the package can be improved.

According to one aspect of the invention there is provided a package of a strip of material comprising:

a strip of material having a first side edge, a second side edge, a first surface and a second surface;

a plurality of layers of the strip;

each layer comprising a plurality of folded portions of the strip, with each portion of the first layer being folded relative to the next portion about a line transverse to the strip;

the portions of each layer being arranged such that the first surface of each portion lies directly in contact with the first surface of a next adjacent portion, such that the second surface of each portion lies directly in contact with the second surface of a next adjacent portion, such that the first side edges of the portions lie in a first common plane of the layer and such that the second side edges of the portions lie in a second common plane of the layer parallel to the first plane;

the layers being parallel and arranged side by side such that the first and second planes of the each layer are parallel to the first and second planes of each of the other layers, thus defining first and second end layers and a plurality of intermediate layers and defining for each intermediate layer a first next adjacent layer on one side and a second next adjacent layer on an opposed side;

the strip being continuous through each layer from a first end portion of the strip at one end of the layer to a second end portion of the strip at an opposed end of the layer, such that a full extent of the strip from the first end portion to the second end portion can be unfolded from the layer by pulling the strip from either end portion;

one end portion of the strip of the first end layer forming a first end of the package for supply to an end use machine and one end portion of the strip of the second end layer forming a second end of the package for connection to a further package;

the first end portion of the strip of each intermediate layer being connected by a spliced portion to one end portion of the strip of the first next adjacent layer and the second end portion of the strip of each intermediate layer being connected by a spliced portion to one end portion of the second next adjacent layer;

such that the strip is continuous through the package and such that a full extent of the strip from the first end portion of said first end layer to said one end portion of said second end layer can be unfolded for supply to said end use machine.

Preferably the first end portion of the strip of each intermediate layer is connected to the first end portion of the strip of the first next adjacent layer and the second end portion of the strip of each intermediate layer is connected to the second end portion of the second next adjacent layer. Other connections are possible.

Preferably each intermediate layer is connected to the first end portion of the strip of the first next adjacent layer by a first transverse portion extending diagonally across the layers and the second end portion of the strip of each intermediate layer is connected to the second end portion of the second next adjacent layer by a second transverse portion extending diagonally across the layers.

Preferably the first end portion of the strip of each intermediate layer and the first end portion of the strip of the first next adjacent layer are co-planar and the first transverse portion is arranged co-planar therewith and wherein the second end portion of the strip of each intermediate layer and the second end portion of the strip of the first next adjacent layer are co-planar and the second transverse portion is arranged co-planar therewith.

Preferably the portions of the strip in all of the layers are parallel although other arrangements where alternate ones of the layers are rotated through 90 degrees are also possible.

Preferably the layers are coextensive such that the package is rectangular particularly although not necessarily square.

Preferably the connection a are arranged such that the first end portion of the strip of each intermediate layer is connected to the first end portion of the strip of the first next adjacent layer by a transverse portion extending diagonally between the layers and the second end portion of the strip of each intermediate layer is connected to the second end portion of the second next adjacent layer by a transverse portion extending diagonally between the layers.

Preferably the connections are effected by splicing after the layers are completed and arranged side by side.

Preferably the package is wrapped by a flexible packaging material such that the layers are held together by pressure from the packaging material.

Preferably the package is wrapped by a flexible packaging material which is sealed and under vacuum such that the layers are maintained in a compressed condition in a direction at right angles to the surfaces of the portions of the strip by pressure from the packaging material.

Preferably the packaging material is dimensioned such that the packaging material expands when the vacuum is released to release the pressure on the layers.

Preferably the layers are horizontal such that loads from upper layers are transferred to lower layers through edges of the strip and there is provided a horizontal pallet for supporting the layers.

Preferably the number of layers is an even number and the end portion of the strip of the first end layer forming a first end of the package for supply to an end use machine and the end portion of the strip of the second end layer forming a second end of the package for connection to a further package are both arranged at the same side of the package.

Preferably the portions are folded so that some of the transverse lines forming the folds are offset from others in a direction longitudinal of the portions.

According to a second aspect of the invention there is provided a method of forming a package of a continuous strip of material comprising:

forming a plurality of layers each containing a strip of the material;

each layer comprising a plurality of folded portions of the strip, with each portion of the layer being folded relative to the next portion of the layer about a line transverse to the strip;

the portions of each layer being folded such that the first surface of each portion lies directly in contact with the first surface of a next adjacent portion, such that the second surface of each portion lies directly in contact with the second surface of a next adjacent portion, such that the first side edges of the portions of the layer lie in a first common plane of the layer and such that the second side edges of the portions of the layer lie in a second common plane of the layer parallel to the first plane;

the strip being continuous through each layer from a first end portion of the strip at one end of the layer to a second end portion of the strip at an opposed end of the layer, such that a full extent of the strip from the first end portion to the second end portion can be unfolded from the layer by pulling the strip from either end portion;

the strip of each layer being separate from the strip of other layers;

arranging the layers side by side with the first and second common planes of each layer parallel to the first and second common planes of other layers to define first and second end layers of the package and a plurality of intermediate layers and to define for each intermediate layer a first next adjacent layer on one side and a second next adjacent layer on an opposed side;

splicing the first end portion of the strip of each intermediate layer to one of the first and second end portions of the strip of the first next adjacent layer;

and splicing the second end portion of the strip of each intermediate layer to one of the first and second end portions of the second next adjacent layer;

such that one end of the strip of the first end layer forms a leading end of the package and one end of the strip of the second end layer forms a trailing end of the package and such that the strip is continuous though the package;

providing a web of a material in a supply;

forwarding the web from the supply;

slitting the web at a plurality of slitting knives at spaced positions across the width of the web to form a plurality of strips of the material, each strip having a first side edge, a second side edge, a first surface and a second surface with the strips lying in a common plane side edge to side edge;

simultaneously laying the strips in parallel layers of portions of the strips, with each layer receiving a respective one of the strips and each layer arranged such that each portion of the layer is folded relative to the next portion of the layer about a line transverse to the strip;

the portions of each layer being folded such that the first surface of each portion lies directly in contact with the first surface of a next adjacent portion, such that the second surface of each portion lies directly in contact with the second surface of a next adjacent portion, such that the first side edges of the portions of the layer lie in a first common plane of the layer and such that the second side edges of the portions of the layer lie in a second common plane of the layer parallel to the first plane;

the strip being continuous though each layer from a first end portion of the strip at one end of the layer to a second end portion of the strip at an opposed end of the layer, such that a full extent of the strip from the first end portion to the second end portion can be unfolded from the layer by pulling the strip from either end portion;

after the layers are formed, forming at least some of the layers into a package to define first and second end layers of the package and a plurality of intermediate layers and to define for each intermediate layer a first next adjacent layer on one side and a second next adjacent layer on an opposed side;

and connecting an end of the strip of each layer to an end of the strip of the next adjacent layer with one end of the strip of the first end layer forming a leading end strip of the package for supply to an end use machine and one end of the strip of the second end layer forming a trailing end strip of the package for connection to a further package such that the strip is continuous though the package and such that a full extent of the strip from said leading end layer to said trailing end can be unfolded for supply to said end use machine.

According to a third aspect of the invention there is provided a method of forming a package of a strip of material comprising:

forming a plurality of parallel layers of the strip, each layer comprising a plurality of folded portions of the strip, with each portion of the layer being folded relative to the next portion of the layer about a line transverse to the strip;

the portions of each layer being folded such that the first surface of each portion lies directly in contact with the first surface of a next adjacent portion, such that the second surface of each portion lies directly in contact with the second surface of a next adjacent portion, such that the first side edges of the portions of the layer lie in a first common plane of the layer and such that the second side edges of the portions of the layer lie in a second common plane of the layer parallel to the first plane;

the strip being continuous though each layer from a first end portion of the strip at one end of the layer to a second end portion of the strip at an opposed end of the layer, such that a full extent of the strip from the first end portion to the second end portion can be unfolded from the layer by pulling the strip from either end portion;

forming at least some of the layers into a package to define first and second end layers of the package and a plurality of intermediate layers and to define for each intermediate layer a first next adjacent layer on one side and a second next adjacent layer on an opposed side;

the first ends of the layers being arranged at one end of the package and the second ends of the layers being arranged at an opposed end of the package;

and splicing the first end portion of the strip of each intermediate layer to the first end portion of the strip of the first next adjacent layer and the second end portion of the strip of each intermediate layer to the second end portion of the second next adjacent layer such that one end of the strip of the first end layer forms a leading end strip of the package for supply to an end use machine and one end of the strip of the second end layer forms a trailing end strip of the package for connection to a further package such that the strip is continuous though the package.

According to a fourth aspect of the invention there is provided a method of forming a package of a strip of material comprising:

providing a web of a material in a supply;

forwarding the web from the supply;

folding the web to form a three dimensional body defined by a plurality of folded portions of the web, with each portion of the web being folded relative to the next portion about a line transverse to the strip;

the folded portions of the web being arranged such that the first surface of each portion lies directly in contact with the first surface of a next adjacent portion, such that the second surface of each portion lies directly in contact with the second surface of a next adjacent portion, such that the first side edges of the portions lie in a first common plane of the web and such that the second side edges of the portions lie in a second common plane of the web parallel to the first plane;

slicing the body in a plurality of parallel planes which lie at right angles to the portions and substantially parallel to said first and second common planes, the parallel planes being spaced across the body to define between each plane and the next a respective one of a plurality of separate layers each formed from a separate strip of the material;

the strip of each layer being continuous though each layer from a first end portion of the strip at one end of the layer to a second end portion of the strip at an opposed end of the layer, such that a full extent of the strip from the first end portion to the second end portion can be unfolded from the layer by pulling the strip from either end portion;

at least some of the layers being formed into a package of the layers in parallel side by side arrangement to define first and second end layers of the package and a plurality of intermediate layers and to define for each intermediate layer a first next adjacent layer on one side and a second next adjacent layer on an opposed side;

and connecting an end of the strip of each layer to an end of the strip of the next adjacent layer with one end of the strip of the first end layer forming a leading end strip of the package for supply to an end use machine and one end of the strip of the second end layer forming a trailing end strip of the package for connection to a further package such that the strip is continuous though the package and such that a full extent of the strip from said leading end layer to said trailing end can be unfolded for supply to said end use machine.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

As shown in FIGS. 1 to 4, the package comprises a generally rectangular body 10 formed from a strip or sheet 11 of a pliable material to be packaged and generally this material will be of a fibrous nature formed by woven or non-woven material although this is not essential to the package structure. Many materials of various thicknesses can be packaged using the festooning technique provided they can accept the creasing necessary at the end of each portion.

Figure 2:
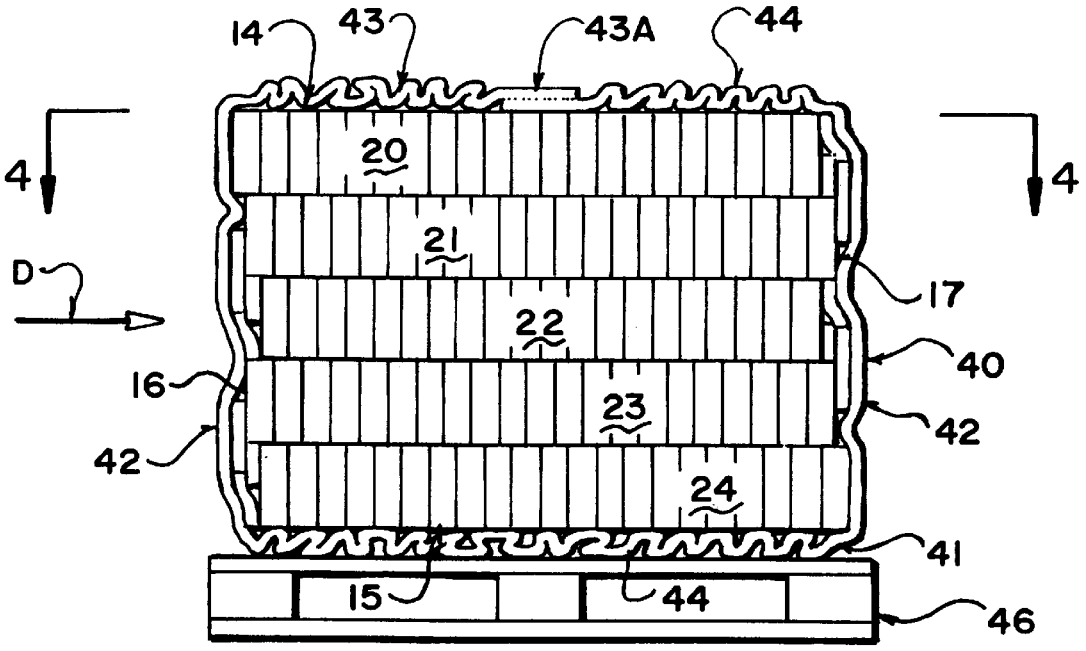
FIG. 2 is a cross sectional view along the lines 2—2 of FIG. 1, with the flexible packaging material and a pallet included and the package rotated to its normal transportation position with the layers horizontal.
Figure 3:
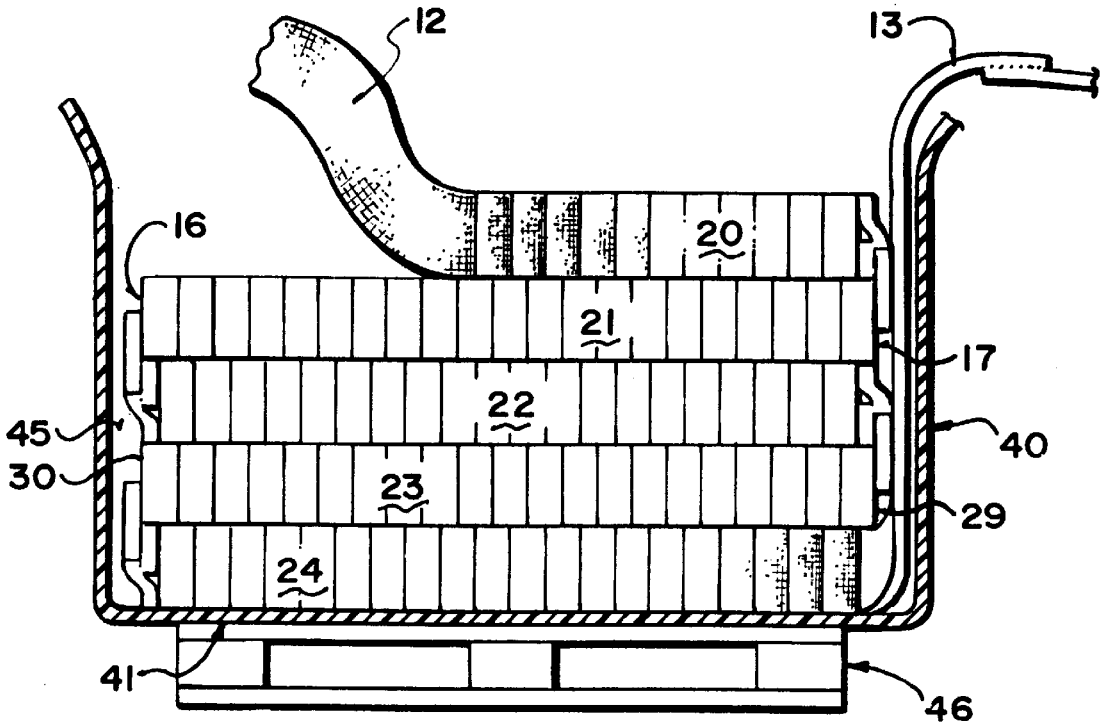
FIG. 3 is a cross sectional view similar to that of FIG. 2 showing the package opened and the strip partly withdrawn.
Figure 4:
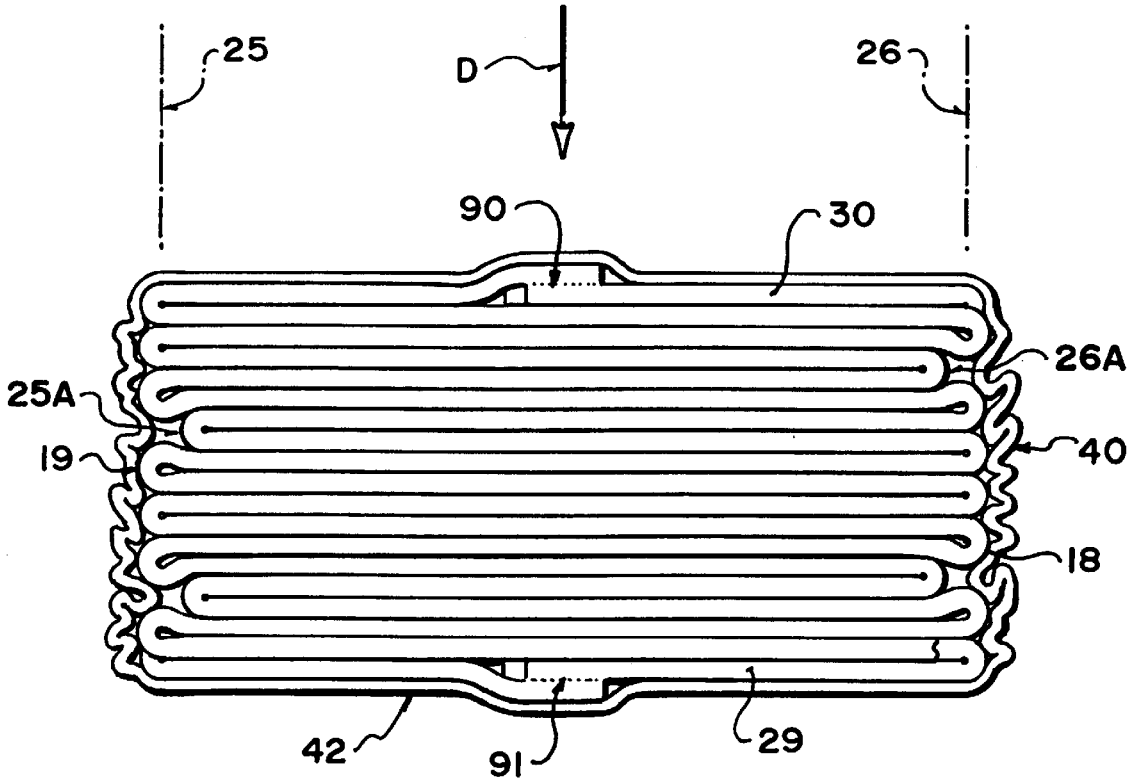
FIG. 4 is a cross sectional view along the lines 4—4 of FIG. 2.

The strip has a leading end 12 and a trailing end 13 of the package and otherwise is substantially continuous through the package. The package when oriented in its normal position for transportation or use as shown in FIGS. 2, 3 and 4 has a top 14, a bottom 15, two sides 16 and 17 and two ends 18 and 19.

The package is formed by a plurality of layers of strips. In the embodiments shown in FIGS. 1 to 4, there are five layers of the strip indicated respectively at 20, 21, 22, 23 and 24. The layers are parallel and an outer side of the layer 20 forms the top surface 14 of the package and an outer side of the layer 24 forms the bottom surface 15 of the package. The package thus has end layers 20 and 24 and a plurality (in this embodiment three) of intermediate layers.

It will be appreciated that the dimensions of the package can of course be varied in accordance with the requirement so that the number of layers, the length of each layer and the height of each layer can be varied and in FIGS. 5 to 10, the package is shown as having eight layers.

Figure 1:
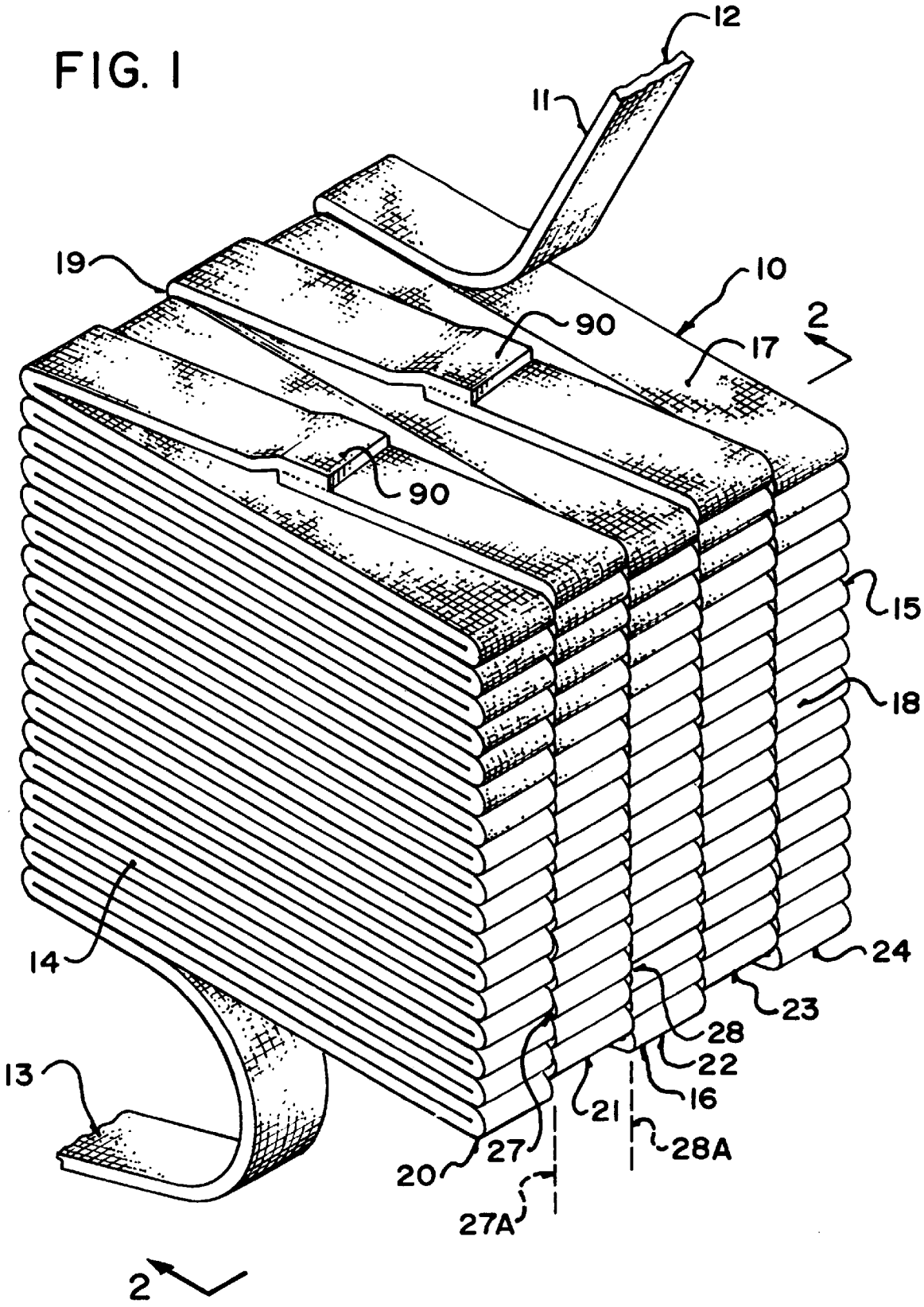
FIG. 1 is a schematic isometric view of a package of a continuous strip according to the present invention, the package including five layers of the strip and being shown with the flexible packaging material omitted for convenience of illustration.

Each layer of the strip comprises a plurality of portions of the strip which are laid on top of one another. Thus as shown in FIG. 4 the portions are folded back and forth at respective end fold lines 25 and 26 to form accordion folds so that the fold lines lie in a common vertical plane defining the ends 18 and 19 of the package. Each portion of the strip lies directly on top of the previous portion so that with the strip being of constant width as shown, the side edges 27 and 28 of the portions of the strip lie in common vertical planes 27A, 28A as shown in FIG. 1. In other words, the side edges 27 of the strips of the layers are aligned and similarly the side edges 28 of the strips of the layers are aligned.

Thus the package is formed by laying the portions each on top of the next from a bottom portion 29 up to a top portion 30 to form the layer.

The package is thus formed from the plurality of layers each of which has a length equal to that of the other layers and therefore equal to that of the package and the layers are formed up to a common height which is therefore equal to the height of the package.

The package is wrapped by a flexible packaging material preferably of heat sealable non-permeable plastics which encompasses the whole of the package as indicated at 40. The packaging material includes a base 41 and sides 42 with a top 43 wrapped over the top of the package and heat sealed as indicated at 43A. The sealed package allows air to be extracted from the package and this vacuum action can be used with physical compression from the sides 16 and 17 of the package so as to compress the package to a reduced height in a vacuum packaging system. The amount of compression can be determined so as to minimize the volume of the package without interfering with the required loft of the product when withdrawn from the package. In this way the package structure avoids the necessity for rigid sides of a box or similar container so the package structure is stable due to the compression of the layers to reduce the height of the layers and due to the pressure of each layer against the sides of the next adjacent layers.

Compression of the package is only possible in the direction D which is at right angles to the surfaces of the portions of the strip. This acts to compress the thickness of the portions so that the dimension of each layer in the direction D is reduced by that compression. Compression along the portions or at right angles to the layers is not possible since this will act to distort the strip. Mechanical compression therefore of the package in the direction D thus reduces the dimension of the package in that direction allowing the air to be withdrawn from the flexible packaging material 40 causing the packaging material to be pulled down onto the package to maintain it in its compressed condition and to apply pressures tending to hold the layers in intimate contact.

In the rest condition of the packaging material as shown in FIG. 3, the base 41 of the packaging material 40 is shaped and dimensioned so as to be slightly larger than the rest or uncompressed condition of the package structure itself. In this way the package structure can be readily inserted into the formed plastics packaging material and can remain in place loosely held by the packaging material. During transportation and storage the package structure is in the compressed and vacuumed condition. In this condition the base 41 of the packaging material and the top 43 of the packaging material are both compressed in the direction D so as to form wrinkles or creases 44. When the vacuum is released, however, the expansion of the package from its compressed condition to its normal relaxed condition will cause the creases 44 to be extracted as shown in FIG. 3. Also, in the expanded condition of FIG. 3, there is a slight space 45 between the sides 42 of the packaging material and the sides 16 and 17 of the package structure allowing the strip to be pulled in the unwrapping process from the ends of the layers without compressing or distorting the end portions 29 and 30.

When wrapped, compressed, sealed and mounted on a transportation pallet 46, the package structure is oriented so that the layers are horizontal. In this orientation, the application of vertical loads onto the package from other packages causes the transfer through the package structure to the pallet 46 without distorting or damaging the strip. This occurs due to the fact that the strip is relatively stiff across its width and when compressed into the layers, the strips together form a substantially rigid structure.

This orientation of the package used for unwinding the package is shown in FIG. 3. thus in FIG. 3 a partial unwinding of the structure is shown in that the top 43 is opened and the leading end 12 of the strip is found and pulled through the opening. By placing the package in this orientation, therefore, each layer in turn can be unwound without the danger of the layer toppling since it is lying on its side supported by the underlying layers.

Each layer is connected to the next by a transverse portion of the strip which extends from one layer to the next. Thus the intermediate layers are each connected so that one end of the strip of that layer is connected to the next adjacent layer on one side and the other end of the strip of that layer is connected to the next adjacent layer on the opposite side. A technique for connecting the strip of each layer to the next layer is shown and described in more detail hereinafter.

As shown in FIG. 4, some of the transverse fold lines can be offset from all of some of the others in a direction longitudinal of the portions. Thus the fold lines 25A are offset inwardly from the plane 25 at one end and the fold lines 26A are similarly offset from the plane 26. This technique can be used to prevent build-up at the ends of the package when the material being packaged is resistance to folding leaving a fold of increased height.

Figure 5:
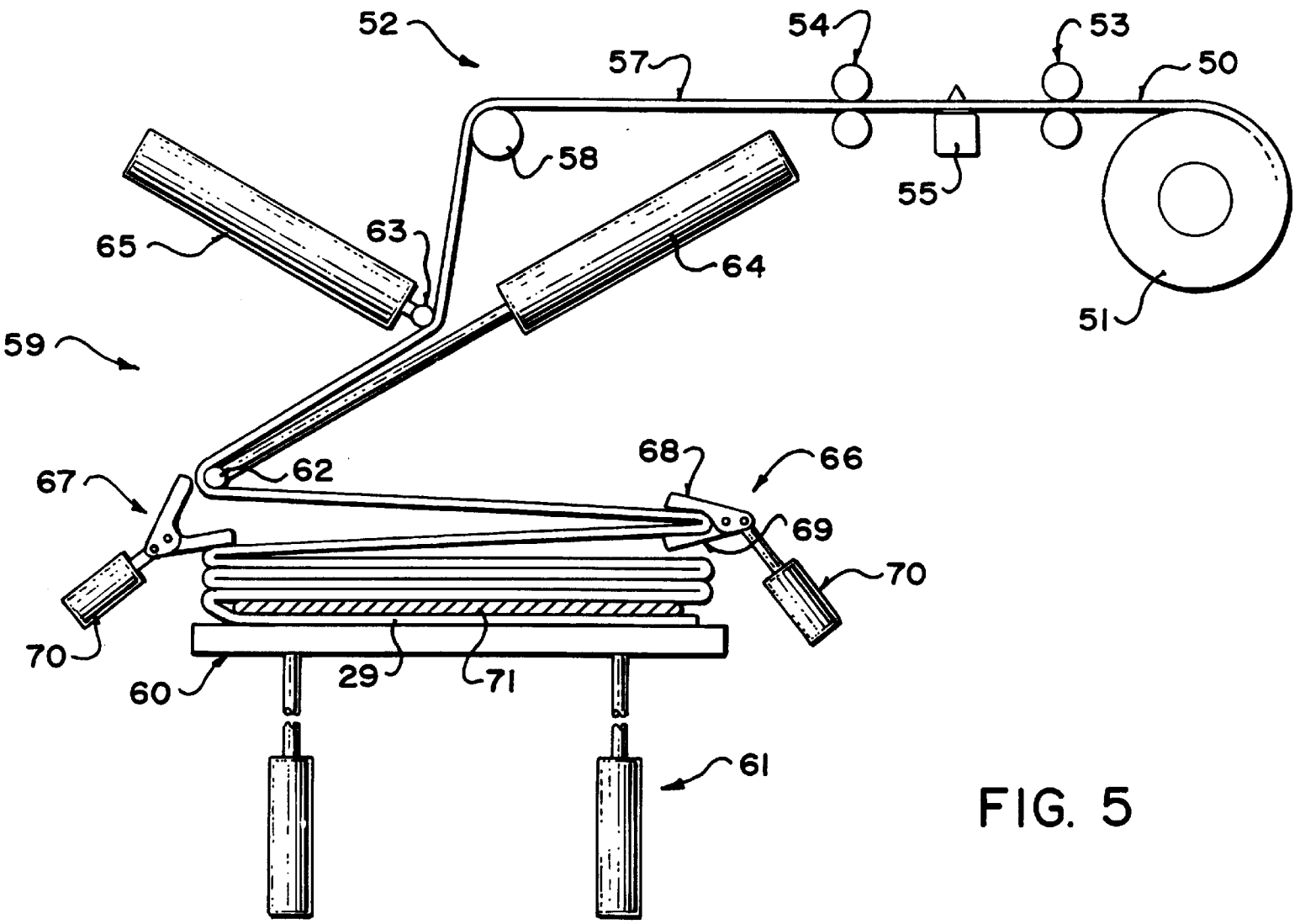
FIG. 5 is an end elevational view of an apparatus and method for forming the package of FIG. 1.
Figure 6:
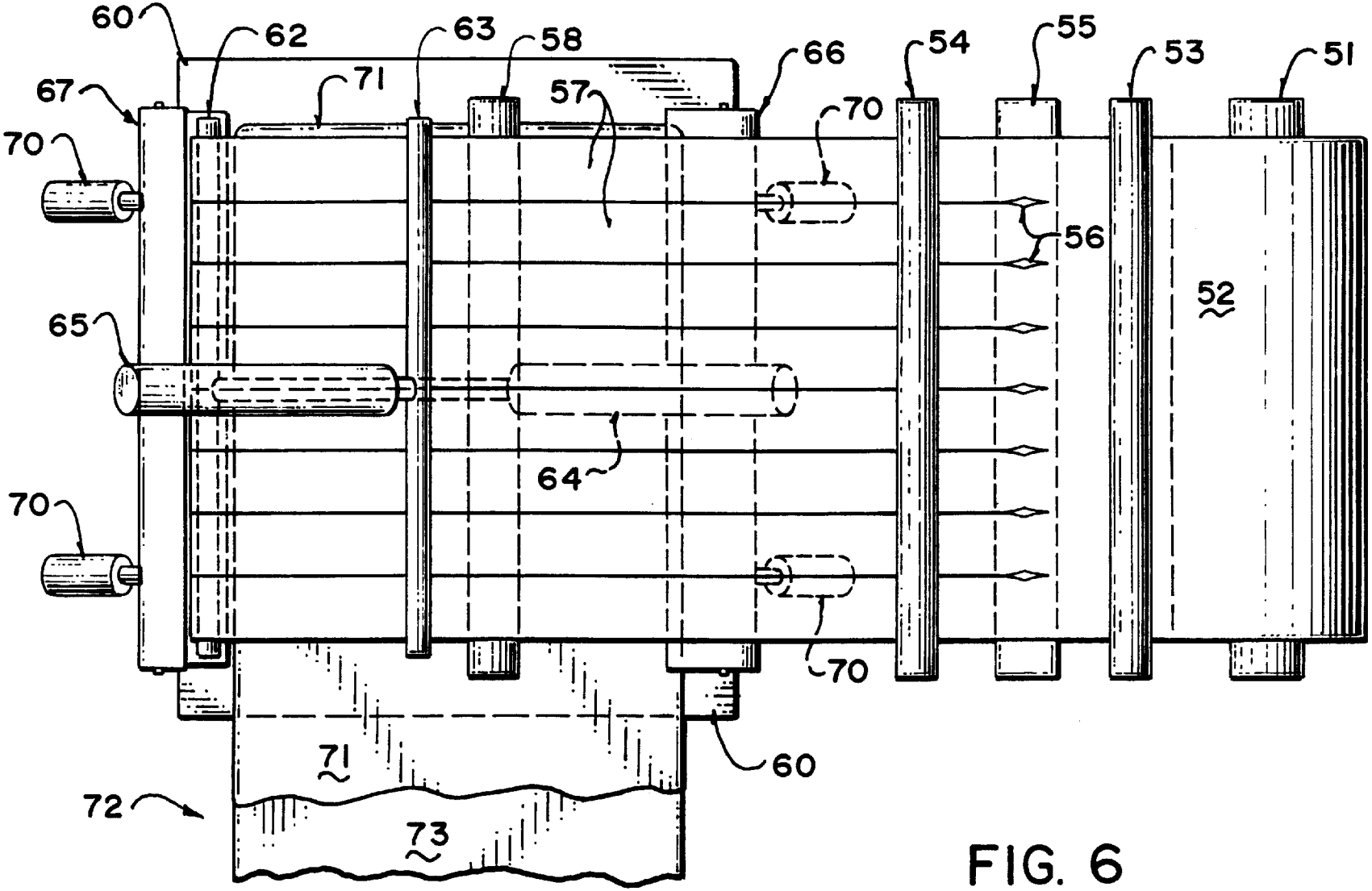
FIG. 6 is a top plan view of the apparatus of FIG. 5.

Turning now to FIGS. 5 and 6, a technique for forming the package structure is shown in more detail. A web 50 is supplied on a material roll 51 and is unwound from the master roll by a feeding and guide system 52 including a two nip roller pairs 53 and 54. A slitter bar 55 is mounted transversely to the web and carries a plurality of slitter knives 56 at transversely spaced positions so as to slit the web into a plurality of strip 57 which are carried forwardly by the guide system 52 so that they are maintained in the common plane of the web and are maintained edge to edge. Thus the strips are in effect maintained in the form of a web without any deviation which could cause tension changes. The coplanar strips 57 are fed over a guide roller 58 into a folding system generally indicated at 59 located underneath the feed roller 58.

The folding system 59 comprises a support table 60 having a width sufficient to receive the full width of the web 50, that is the strips in side by side arrangement. The support table 60 has a length sufficient to receive the portions of the folded strips in the structure as previously described. The table 60 is mounted upon a jacking system 61 which is shown only schematically and acts to raise and lower the table so that the table is gradually lowered as the strips are folded onto the table.

The folding system further includes a pair of folding bars 62 and 63 which act to fold the strips back and forth across the table 60. The folding bar 62 is mounted on an actuating cylinder 64 and similarly the folding bar 63 is mounted on an actuating cylinder 65. In FIG. 5, the folding bar 63 is shown in the retracted position and the folding bar 62 is shown in the extended position. The folding bars move alternately between these positions so that the folding bar 62 is firstly retracted and then the folding bar 63 is extended so as to move the strips across the table to form the overlying portions of the strip previously described. The folding bars 62 and 63 extend across the full width of the web so as to engage all of the strips simultaneously and to move those strips simultaneously into the folded positions. The strips thus remain in parallel edge to edge position as they are being folded. The folding bars 62 and 63 may be in the form of rollers to allow the material to pass over the bar without friction while the material is being pushed by the bar to the required position on the table. The mounting system for supporting the cylinders is not shown for convenience of illustration and this will of course be well apparent to one skilled in the art.

The folding system further includes a pair of creasing jaws 66 and 67 each arranged at the end of the stroke of a respective one of the folding bars. The creasing jaws also extend across the full width of the web and comprise a pair of jaw elements 68 and 69 which can be moved from an open position as indicated on the left and a closed creasing position as indicated on the right. The jaws are moved between these positions by an actuating cylinder 70 timed in relation to the operation of the cylinder 64 and 65. In addition to the opening and closing movement, the creasing jaws also move inwardly and outwardly in a horizontal direction relative to the table so as to release each fold or crease line after it is formed to allow that layer and the fold at the end of the layer to be dropped onto the previous layers and to move downwardly with the table 60. Thus as illustrated, the creasing jaw 66 at the completion of the crease moves outwardly away from the crease or fold line and at the same time opens slightly to release the fold between the two portions to drop downwardly onto the underlying portions. The jaws then open and move back inwardly ready to receive the portion of the strips wrapped around the folding bar and to grasp those as they are released from the folding bar as shown at the creasing jaw 67 in FIG. 5. This compound motion can be effected by suitable mechanical linkage operated by the actuating cylinder 70, this arrangement again being well apparent to one skilled in the art.

The strips are therefore simultaneously laid down in portions folded back and forth on top of one another to simultaneously form a plurality of the layers of the package structure. Each layer is thus formed by a single respective one of the strips. The strip is continuous throughout the layer. In order to provide a continuous strip, one or more master rolls may be spliced into the supply with the splice being formed across the width of the web so that each slit strip also acts to slit through the splice.

The back and forth folding of the strips into the layers is continued until sufficient of the portions are applied to the layer to complete the layer in accordance with the required dimensions of the layer.

As shown in FIG. 5, a bottom clamping plate 71 of a clamping system is generally indicated at 72. The clamping system comprises the bottom plate 71 and a top plate 73. The clamping plates are movable by an actuation system schematically indicated at 74. The clamping plates 71 and 73 are parallel and initially horizontal so that they can be inserted between the portions of the strips across the full width of the web.

The actuation system 74 provides complex movement of the clamping plates. Thus the clamping plates can be extended and retracted in a longitudinal direction independently of one another. The clamping plates can be moved together to reduce the spacing therebetween while remaining parallel in a clamping action so as to squeeze the portions of the web between the clamping plates. The clamping plates can be rotated about a central horizontal axis through 90° and 180° so as to rotate the package structure to present different surfaces at the top. The clamping plates can be translated from a position on top of the table 60 to a separate location for depositing the package structure onto the pallet 46, if this is used in transportation.

The bottom clamping plate 71 is inserted on top of the lowermost portion 29 so that the lower most portion lies underneath the clamping plate and is therefore exposed when the clamping plate and the package are removed from the table 60. In the formation of the package, therefore, the clamping plate 71 is extended into position on top of the table after the lowermost portion 29 is laid, following which the further portions are laid on top of the clamping plate 71.

Figure 7:
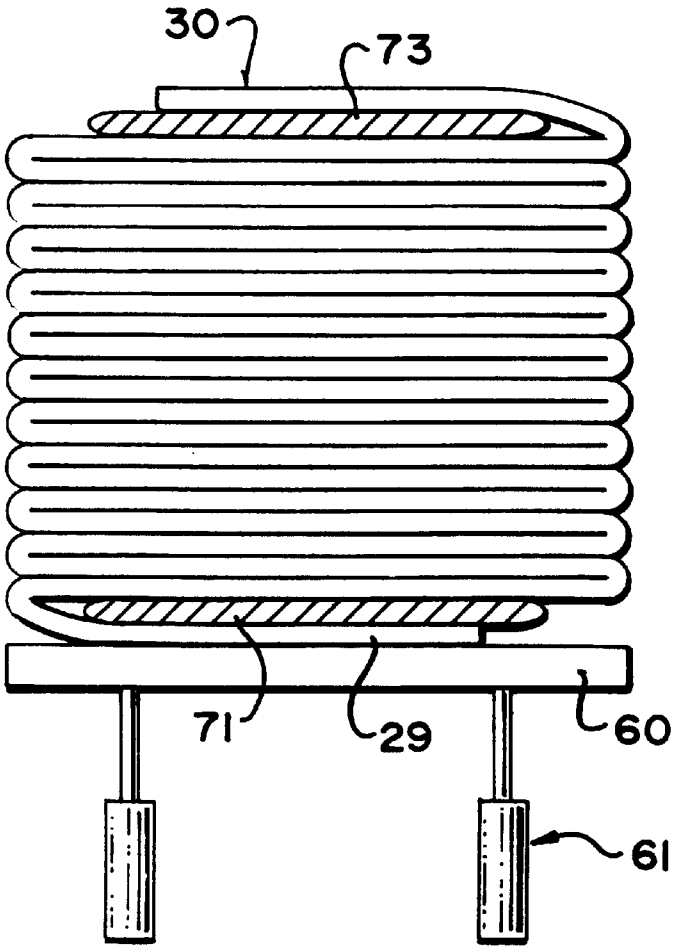
FIG. 7 is a side elevational view of the apparatus similar to that of FIG. 5 showing the top clamping plate moved into position after completion of the required number of portions in each layer, the folding bars and the creasing jaws being omitted for convenience of illustration.

Symmetrically the top clamping plate 73 is moved into position, as shown in FIG. 7, when the number of portions in the layer is complete and immediately prior to the laying of the last portion 30. Therefore again, the last portion 30 is exposed when the clamping system including the clamping plate 71 and 73 and the package are removed from the table 60.

After the folding action is therefore complete, the clamping action is effected by extension of the top clamping plate 73 and by a clamping movement squeezing the clamping plates together. When this is completed, the package structure can be removed from the table 60 for the further completing actions as described hereinafter and the folding of a further package structure can be recommenced using a second clamping system independent of the first.

Figure 8:
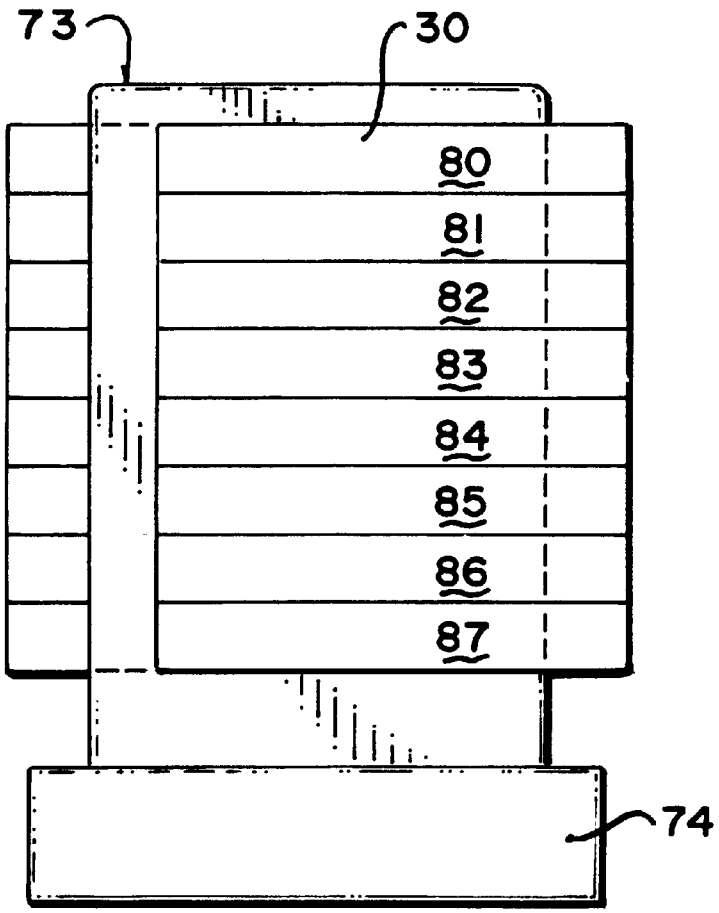
FIG. 8 is a top plan view of the elements of the apparatus as shown in FIG. 7 after removal of the clamped layers from the folding system.

It will be appreciated that in the stage as shown in FIG. 8 in which the package structure is removed from the table 60, each of the layers is separate from and independent of the other layers since each is formed by a respective one of the strips slit from the web 50. Thus in FIG. 8 there are shown eight layers 80 through 87 arranged side by side with the sides edges of the layers in contact as previously described in relation to the package structure shown in FIGS. 1 through 4.

Figure 10:
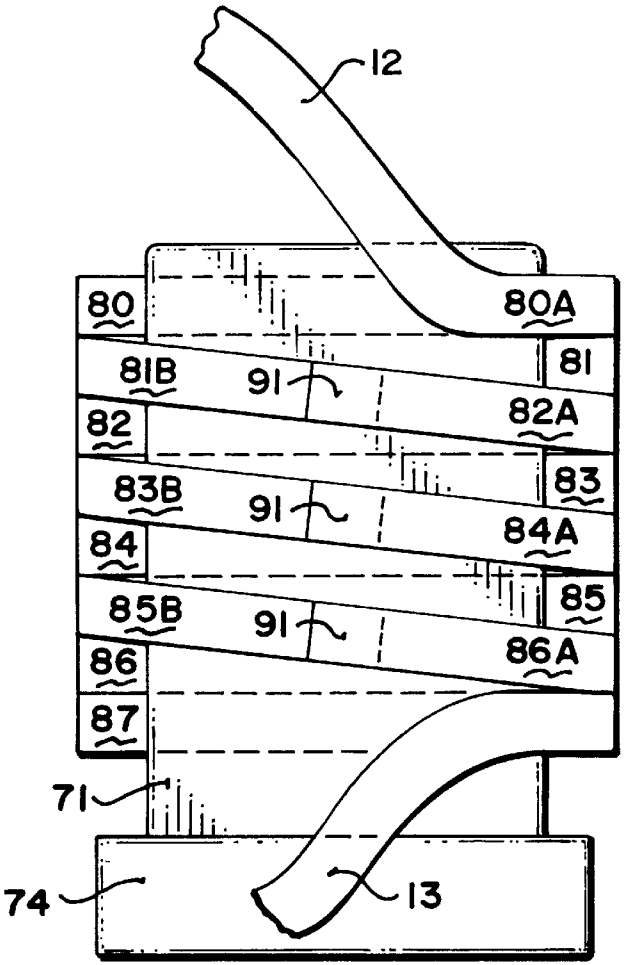
FIG. 10 is a bottom plan view of the elements of the apparatus as shown in FIG. 8 after completion of the splices in the strip between the layers and showing the free ends of the strip at the end layers of the package.
Figure 9:
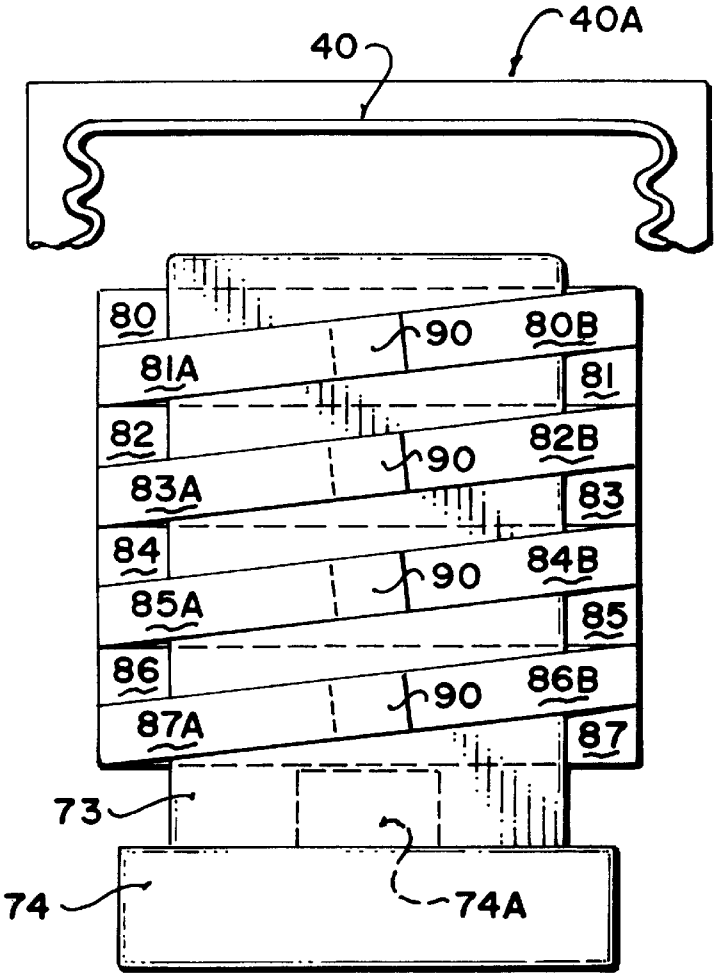
FIG. 9 is a top plan view of the elements of the apparatus as shown in FIG. 8 after completion of the splices in the strip between the layers.

Turning now to FIGS. 9 and 10, the technique for interconnecting the layers is shown. FIG. 9 shows the package structure in the orientation of FIG. 8. FIG. 10 shows the package after it has been inverted or rotated through 180° about the central axis of the clamping system.

Thus it will be noted that one end 80A of the layer 80 forms the leading end 12 of the package. As shown in FIG. 9 a second end 80B of the layer 80 is spliced by a splice 90 to a leading end 81A of the layer 81.

The opposite end 81B of the layer 81 is spliced by a splice 91 to a leading end 81A of the layer 82. As shown in FIG. 9 the trailing end 82B of the layer 80 is spliced to the leading end 83A of the layer 83 by a splice 91.

In a symmetrical manner, as shown in FIG. 9 the trailing end 84B of the layer 84 is spliced to the leading end 85A of the layer 85 by a splice 90. In addition a further splice 90 interconnects the trailing end 86B of layer 86 and the leading end 87A of the layer 87.

As shown in FIG. 10, two further splices 91 are formed between the trailing end 83B of layer 83 and the leading end 84A of the layer 84, and between the trailing end 85B of a layer 85 and the leading end 86A of the layer 86.

The splices 90 are all formed on top of the top clamping plate 73 using the clamping plate as a support base for effecting a strong seal which in some cases may be usable in the end use machine without the necessity for cutting out the splice. Since the splice is formed while the package is stationary, it can be formed using careful technique such as stitching or heat sealing depending upon the materials involved. In this way the splice can be made as effective as possible so as to minimize the inconvenience of a splice in subsequent processing. Various techniques for splicing are available depending upon the type of material to be spliced.

After the package is inverted as shown in FIG. 10, the splices 91 can be formed on top of the bottom plate 71 which is now at the top, again using that plate as a support base.

It will be noted from FIGS. 9 and 10 that the spliced portions extend diagonally from one layer to the next. In order to achieve this arrangement from the construction shown in FIG. 8, it is necessary to pull a part of the strip from underneath the top plate 73 at the layers 81, 83, 85 and 87 and to connect that pulled portion to the exposed portion of the strip at the layers 80, 82, 84 and 86. In most cases this necessitates cutting of an extra exposed piece as waste leaving a direct connection forming the diagonally extending spliced portion, such as that defined by the ends 81A and 80B connected by the splice 90.

After the splices are complete, the package is inserted into the bag 40 supported in a vacuum packing system schematically indicated at 40A. The bag is dimensioned as previously described so that the insertion of the package into the bag can be effected without difficulty. Once inserted into the bag, the clamping plates 71 and 73 are retracted by the actuation system 74 using a push rod 74A to push the package away from the clamping plates so that the package is released from the clamping plates and deposited into the bag 40. When placed into the bag or wrapping material, the vacuum sealing system 40A is operated to complete the compression of the package and the sealing of the vacuum packing material 40 as previously described.

In an alternative technique for forming the package in which the package is competed in place on the table, the bottom splices are formed in place on the table before the layers are stacked on top of the splices. The top splices are then completed at the top of the layers and the package wrapped as described above. Folding can in some cases continue on a second table while the package is finished at the first table. This technique reduces the handling of the package while it is unwrapped thus reducing the possibility of damage.

Figure 11:
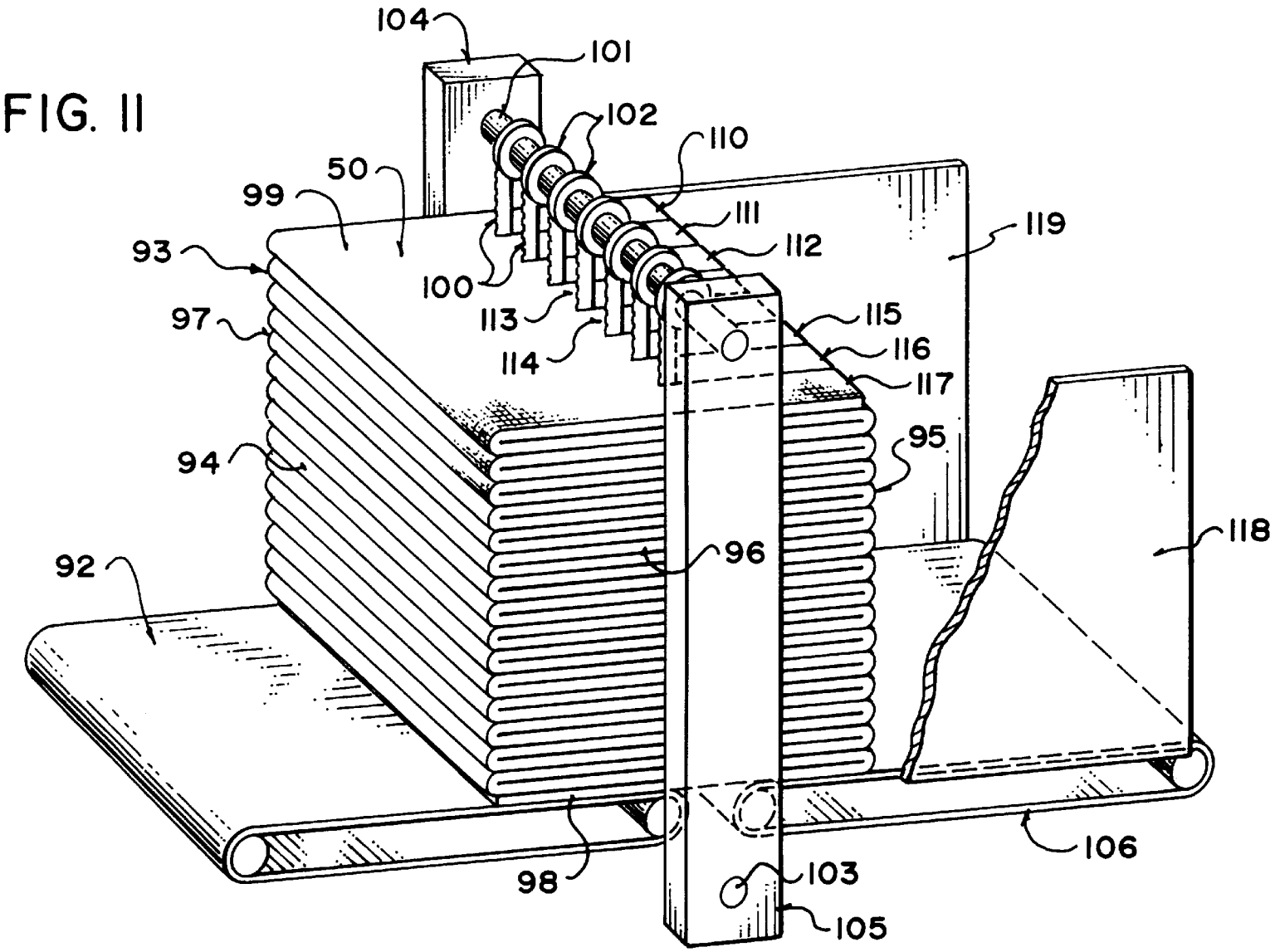
FIG. 11 is an isometric view showing a step in an alternative method for forming a package according to the present invention.

A modified method for manufacturing the package of the structure as shown in FIGS. 1 through 4 uses basically the steps shown in FIGS. 5, 6, 9 and 10 but instead of using the slitter bar 55 of FIGS. 5 and 6 uses the cutting method shown in FIG. 11.

Thus the slitter 55 of FIGS. 5 and 6 is removed and the arrangement as shown in those figures operated to effect a folding action of the complete web without slitting. The web is thus folded back and forth as shown to form a rectangular block of the web.

The body formed by the folded web is then transferred from the table 60 onto a belt conveyor 92. The body 93 has the web 50 folded back and forth as shown so as to form on the body ends 94 and 95 containing the fold lines of the web together with sides 96 and 97 which contain the overlying side edges of the portions of the web. A lowermost web portion 98 is at the bottom of the body and an uppermost web portion 99 is at the top of the body.

A cutting assembly for the body comprises a plurality of band saw blades 100 arranged at spaced positions along a shaft 101. The band saw blades are each mounted on a respective one of a plurality of pulleys 102 so that rotation of the shaft drives the band saw blade along its length. The band saw blades are arranged to stand vertically in parallel vertical planes parallel to the sides 96 and 97 of the body. Each band saw 101 has an idler pulley mounted on a shaft 103 underneath the body and at the discharge end of the conveyor 92. The shafts 103 and 101 are mounted on two parallel support towers 104 and 105 at respective sides of the body. A second conveyor 106 is arranged with an upper run lying in a common horizontal plane with the upper run of the conveyor 92 so as to carry the body through the cutting assembly from an initial uncut position on top of the conveyor 92 to a second position on top of a conveyor 106 in which the body has been cut by the band saws to separate the body into a plurality of parallel layers 110 through 115 which are in effect of the same construction as the layers 80 through 87 of the arrangement shown in FIGS. 5 and 6. Two side guide walls 116 and 117 are provided for engaging the sides 96 and 97 of the body after cutting to maintain the integrity of the body as it is carried through the cutting station and after cutting is complete while the body is standing on the conveyor 106.

The band saw is of a type known as a razor knife band which is intended to effect a cutting action without removing material from the body as the cutting occurs. The razor knife band is of a type having a scalloped front edge chamfered on both sides of the front edge. The fact that the material can be slightly distorted allows the band blade to slide through the material without removing material from the body. The blade is arranged so that it can accommodate the significant length between the shafts 101 and 103 without significantly distorting from the straight line therebetween. An increased width of the blade may therefore be necessary in view of the relatively long length of the blade to provide a cutting action of up to four feet of the height of the body.

Subsequent to the cutting action, the splicing arrangement shown in FIGS. 9 and 10 is effected to connect the layers 110 through 115 in a similar manner to that of the layers 80 through 87. During the splicing action, the body is carried in a pair of clamping plate son a clamping system similar to the arrangement 74 in FIGS. 9 and 10. The splicing, compressing, bagging and sealing steps are therefore substantially the same as previously described.

The individual layers for a package structure of this type can therefore be formed in different ways and can be assembled into a package structure, following which the splicing is effected to connect the strip of the layers into a continuous length from a leading end of the package to a trailing end of the package.

The technique using the cutting action through the body is particularly effective in that it ensures that the layers are entirely separate without any interleaving and allows the folding action to be effected more rapidly.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A package comprising:

a plurality of layers of strip material, each layer formed of a strip of material having a first side edge, a second side edge, a first surface and a second surface;

each layer comprising a plurality of folded portions of the strip, with each portion of the layer being folded relative to the next portion about a fold line transverse to the strip;

such that the first surface of each portion lies directly in contact with the first surface of a next adjacent portion and the second surface of each portion lies directly in contact with the second surface of a next adjacent portion;

and such that the first side edges of the portions are aligned and also the second side edges of the portions are aligned;

wherein the plurality of layers are arranged parallel and arranged side by side thus defining first and second end layers and at least one intermediately layer and defining for said at least one intermediate layer a first next adjacent layer on one side and a second next adjacent layer on an opposed side;

the strip being continuous through each layer from a first end portion of the strip at one end of the layer to a second end portion of the strip at an opposed end of the layer, such that a full extent of the strip from the first end portion to the second end portion can be unfolded from the layer by pulling the strip from either end portion;

the layers being arranged such that the first end portions thereof lie in a common first plane at a first end of the package and the second end portions lie in a common second plane parallel to the first plane at a second end of the package;

one end portion of the strip of the first end layer forming a first end of the package for supply to an end use machine and one end portion of the strip of the second end layer forming a second end of the package for connection to a further package;

an end of the first end portion of the strip of said at least one intermediate layer being connected by a first spliced traverse portion to an end of the first end portion of the strip of the first next adjacent layer and the second end portion of the strip of each intermediate layer being connected by a second spliced traverse portion to the second end portion of the second next adjacent layer;

such that the strip is continuous though the package and such that a full extent of the strip from the first end portion of said first end layer to said one end portion of said second end layer can be unfolded for supply to said end use machine;

the first spliced traverse portion lying wholly in the first plane and the second spliced traverse portion lying wholly in the second plane.

2. The package according to claim 1 wherein the fold lines of the layers lie in two parallel planes at right angles to the first and second planes such that the package is rectangular.

3. The package according to claim 1 wrapped by a flexible packaging material such that the layers are held together by pressure from the packaging material.

4. The package according to claim 1 wrapped by a flexible packaging material comprising a closed bag from which air has been withdrawn which is sealed against ingress of air such that the layers are maintained in a compressed condition in a direction at right angles to the surfaces of the portions of the strip by atmospheric pressure on the packaging material.

5. The package according to claim 4 wherein the closed bag is dimensioned such that a length of the bag is sufficient to receive a dimension of the package from the first plane to the second plane when the package is released from the compressed condition.

6. The package according to claim 1 wherein the package is oriented such that the layers are horizontal.

7. The package according to claim 6 wherein there is provided a horizontal pallet for supporting the layers.

8. The package according to claim 1 wherein the number of layers is an even number and wherein said one end portion of the first end layer and said one end portion of the second end layer are both arranged at said first plane.

9. The package according to claim 1 wherein the fold lines of some of the folded portions are offset from others in a direction longitudinal of the folded portions.

10. A method of forming a package comprising:

forming a plurality of layers, each layer containing an elongate strip of a material having a first side edge, a second side edge, a first surface and a second surface;

each layer comprising a plurality of folded portions of the strip, wherein each portion of the layer is folded relative to the next portion of the layer about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned;

the strip being continuous though each layer from a first end portion of the strip at one end of the layer to a second end portion of the strip at an opposed end of the layer, such that a full extent of the strip from the first end portion to the second end portion can be unfolded from the layer by pulling the strip from either end portion;

arranging the layers side by side to define first and second end layers of the package and at least one intermediate layer and to define for said at least one intermediate layer a first next adjacent layer on one side and a second next adjacent layer on an opposed side;

arranging the layers such that the first end portions thereof lie in a common first plane at a first end of the package and the second end portions lie in a common second plane parallel to the first plane at a second end of the package;

splicing an end of the first end portion of the strip of said at least one intermediate layer being connected to an end of the first end portion of the strip of the first next adjacent layer by a first splice traverse portion arranged wholly in the first plane;

and splicing an end of the second end portion of the strip of said at least one intermediate layer to an end of the second end portion of the second next adjacent layer by a second splice traverse portion arranged wholly in the second plane;

such that one end of the strip of the first end layer forms a leading end of the package and one end of the strip of the second end layer forms a trailing end of the package and such that the strip is continuous though the package.

11. The method according to claim 10 wherein the layers are formed by:

providing a web of the material in a supply;

forwarding the web from the supply;

folding the web to form a three dimensional body defined by a plurality of folded portions of the web, with each portion of the web being folded relative to the next portion about a line transverse to the web;

the folded portions of the web being arranged such that the first surface of each portion lies directly in contact with the first surface of a next adjacent portion, such that the second surface of each portion lies directly in contact with the second surface of a next adjacent portion, such that the first side edges of the portions lie in a first common plane and such that the second side edges of the portions lie in a second common plane parallel to the first plane;

and slicing the body in a plurality of parallel planes which lie at right angles to the first and second surfaces of the portions and substantially parallel to said first and second common planes, the parallel planes being spaced across the body to define said layers therebetween.

12. The method according to claim 11 wherein the body is sliced simultaneously by a plurality of spaced blades.

13. The method according to claim 10 wherein the layers are formed by:

providing a web of the material in a supply;

forwarding the web from the supply;

slitting the web at a plurality of slitting knives at spaced positions across the width of the web to form a plurality of separate strips of the material, each strip having a first side edge, a second side edge, a first surface and a second surface with the strips lying in a common plane side edge to side edge;

and simultaneously laying the strips in said parallel side by side layers.

14. The method according to claim 10 wherein the fold lines of the layers lie in two parallel planes at right angles to the first and second planes such that the package is rectangular.

15. The method according to claim 10 including wrapping the layers of the package with a flexible packaging material such that the layers are held together by pressure from the packaging material.

16. The method according to claim 10 including wrapping the layers of the package with a flexible packaging material comprising a closed bag from which air has been withdrawn which is sealed against ingress of air such that the layers are maintained in a compressed condition in a direction at right angles to the surfaces of the portions of the strip by atmospheric pressure on the packaging material.

17. The method according to claim 16 wherein the closed bag is dimensioned such that a length of the bag is sufficient to receive a dimension of the package from the first plane to the second plane when the package is released from the compressed condition.

18. The method according to claim 10 including orienting the package such that the layers are horizontal.

19. The method according to claim 10 wherein the fold lines of some of the folded portions are offset from others in a direction longitudinal of the folded portions.

20. A method of packaging and dispensing a strip of material, the method comprising the steps of:

forming a plurality of layers of the strip, the strip having a first side edge, a second side edge, a first surface and a second surface;

each layer comprising a plurality of folded portions of the strip, wherein each portion of the layer is folded relative to the next portion of the layer about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned;

the strip being continuous though each layer from a first end portion of the strip at one end of the layer to a second end portion of the strip at an opposed end of the layer, such that a full extent of the strip from the first end portion to the second end portion can be unfolded from the layer by pulling the strip from either end portion;

an end of the strip of each layer being connected to an end of the strip of the next adjacent layer such that the strip is continuous through the package from a leading end of the package at a first end layer to a trailing end of the package at a second end layer remote from the first layer;

positioning the layers on a support surface such that the first and second surfaces of the folded strip portions stand substantially at right angles to the support surface, so that each successive upper layer has a side surface thereof resting upon an adjacent lower layer, so that the first end layer is uppermost and such that the second end layer is lowermost;

disposing the leading end of the strip in operative engagement with a feeding apparatus; and progressively feeding the strip from each layer of the package in turn to while a remaining portion of the package remains stable on the support surface.

21. The method according to claim 20 including the steps of:

arranging the layers such that the first end portions thereof lie in a common first plane at a first end of the package and the second end portions lie in a common second plane parallel to the first plane at a second end of the package;

splicing an end of the first end portion of the strip of said at least one intermediate layer to an end of the first end portion of the strip of the first next adjacent layer by a first splice traverse portion arranged wholly in the first plane;

and splicing an end of the second end portion of the strip of said at least one intermediate layer to an end of the second end portion of the second next adjacent layer by a second splice traverse portion arranged wholly in the second plane.

22. The method according to claim 20 wherein the layers are formed by:

providing a web of the material in a supply;

forwarding the web from the supply;

folding the web to form a three dimensional body defined by a plurality of folded portions of the web, with each portion of the web being folded relative to the next portion about a line transverse to the web;

the folded portions of the web being arranged such that the first surface of each portion lies directly in contact with the first surface of a next adjacent portion, such that the second surface of each portion lies directly in contact with the second surface of a next adjacent portion, such that the first side edges of the portions lie in a first common plane and such that the second side edges of the portions lie in a second common plane parallel to the first plane;

and slicing the body in a plurality of parallel planes which lie at right angles to the first and second surfaces of the portions and substantially parallel to said first and second common planes, the parallel planes being spaced across the body to define said layers therebetween.

23. The method according to claim 22 wherein the body is sliced simultaneously by a plurality of spaced blades.

24. The method according to claim 20 wherein the layers are formed by:

providing a web of the material in a supply;

forwarding the web from the supply;

slitting the web at a plurality of slitting knives at spaced positions across the width of the web to form a plurality of separate strips of the material, each strip having a first side edge, a second side edge, a first surface and a second surface with the strips lying in a common plane side edge to side edge;

and simultaneously laying the strips in said parallel side by side layers.

25. The method according to claim 20 wherein the fold lines of the layers lie in two parallel planes at right angles to the first and second planes such that the package is rectangular.

26. The method according to claim 20 wherein the fold lines of some of the folded portions are offset from others in a direction longitudinal of the folded portions.

27. The method according to claim 20 wherein the plurality of layers are arranged side by side with the side edges of the strip portions of each layer adjacent the side edges of a next adjacent stack without intervening rigid container walls.

28. The method according to claim 20 including the step of arranging the plurality of layers such that the strip of each stack has the side edges thereof along the complete length of the strip unattached from the side edges of the strip of a next adjacent layer.

29. The method according to claim 20 including the step of forming the strip of each layer by longitudinally slitting a web such that each side edge of the strip is a slit edge completely separated from the strip of a next adjacent layer.

30. The method according to claim 20 wherein the entire surface in the first plane and the entire surface in the second plane of each of the layers is placed under compression by an external force in a direction at right angles to the first and second planes and the package is engaged by a packaging material which maintains the compression and wherein the amount of compression applied by said compression applying step is sufficient to reduce the thickness of each strip portion of said at least one layer.

31. The method according to claim 30 wherein the strip is fibrous.

32. The package according to claim 1 wherein the plurality of layers are arranged side by side with the side edges of the strip portions of each layer adjacent the side edges of a next adjacent stack without intervening rigid container walls.

33. The package according to claim 1 wherein the plurality of layers are arranged such that the strip of each stack has the side edges thereof along the complete length of the strip unattached from the side edges of the strip of a next adjacent layer.

34. The package according to claim 1 wherein the entire surface in the first plane and the entire surface in the second plane of each of the layers is maintained under compression by a packaging material and wherein the amount of compression is sufficient to reduce the thickness of each strip portion of said layers.

35. The package according to claim 34 wherein the strip is fibrous.

36. The method according to claim 10 wherein the plurality of layers are arranged side by side with the side edges of the strip portions of each layer adjacent the side edges of a next adjacent stack without intervening rigid container walls.

37. The method according to claim 10 including the step of arranging the plurality of layers such that the strip of each stack has the side edges thereof along the complete length of the strip unattached from the side edges of the strip of a next adjacent layer.

38. The method according to claim 10 including the step of forming the strip of each layer by longitudinally slitting a web such that each side edge of the strip is a slit edge completely separated from the strip of a next adjacent layer.

39. The method according to claim 10 wherein the entire surface in the first plane and the entire surface in the second plane of each of the layers is placed under compression by an external force in a direction at right angles to the first and second planes and the package is engaged by a packaging material which maintains the compression and wherein the amount of compression applied by said compression applying step is sufficient to reduce the thickness of each strip portion of said at least one layer.

40. The method according to claim 39 wherein the strip is fibrous.

* * * * *